US008167550B2

(12) United States Patent
Nakamura et al.

(10) Patent No.: US 8,167,550 B2
(45) Date of Patent: May 1, 2012

(54) BLOWER UNIT

(75) Inventors: Takahito Nakamura, Kariya (JP); Koji Ito, Nagoya (JP); Masaharu Sakai, Obu (JP)

(73) Assignee: Denso Corporation, Kariya (JP)

( * ) Notice: Subject to any disclaimer, the term of this patent is extended or adjusted under 35 U.S.C. 154(b) by 739 days.

(21) Appl. No.: 12/316,247

(22) Filed: Dec. 10, 2008

(65) Prior Publication Data

US 2009/0180868 A1 Jul. 16, 2009

(30) Foreign Application Priority Data

Dec. 18, 2007 (JP) ..... 2007-326316
Oct. 23, 2008 (JP) ..... 2008-272922

(51) Int. Cl.
*F04D 29/44* (2006.01)

(52) U.S. Cl. ..... 415/206; 415/98; 415/203; 415/99

(58) Field of Classification Search ..... 415/206, 415/204, 203, 208.3, 58.7, 228, 173.6, 98, 415/99, 101
See application file for complete search history.

(56) References Cited

U.S. PATENT DOCUMENTS

| | | | | |
|---|---|---|---|---|
| 5,352,089 | A | 10/1994 | Tokunaga et al. | |
| 5,511,939 | A | 4/1996 | Tokunaga et al. | |
| 2002/0025253 | A1* | 2/2002 | Ozeki et al. | 415/206 |
| 2002/0136634 | A1* | 9/2002 | Chapman | 415/208.2 |
| 2003/0039548 | A1* | 2/2003 | Kim | 416/186 R |
| 2003/0053911 | A1* | 3/2003 | Sakai et al. | 415/206 |
| 2003/0228213 | A1* | 12/2003 | Bikos et al. | 415/101 |
| 2004/0115039 | A1* | 6/2004 | Botros et al. | 415/101 |
| 2005/0152779 | A1* | 7/2005 | Williams et al. | 415/206 |
| 2007/0147995 | A1* | 6/2007 | Araki | 415/204 |
| 2008/0095629 | A1* | 4/2008 | Eguchi et al. | 416/179 |
| 2008/0279681 | A1* | 11/2008 | Eguchi et al. | 415/206 |

FOREIGN PATENT DOCUMENTS

| | | |
|---|---|---|
| GB | 2 289 090 | 11/1995 |
| JP | 53-070408 | 6/1978 |
| JP | 61-160300 | 10/1986 |
| JP | 62-173600 | 11/1987 |
| JP | 05-296194 | 11/1993 |
| JP | 07-027097 | 1/1995 |
| JP | 08-109897 | 4/1996 |
| JP | 11-270495 | 10/1999 |
| JP | 2001-065493 | 3/2001 |
| JP | 2002-161890 | 6/2002 |
| JP | 2002-202093 | 7/2002 |

OTHER PUBLICATIONS

Office action dated Nov. 10, 2009 in corresponding Japanese Application No. 2008-272922.

* cited by examiner

*Primary Examiner* — Caridad Everhart
(74) *Attorney, Agent, or Firm* — Harness, Dickey & Pierce, PLC

(57) ABSTRACT

A blower unit includes a rotation shaft, a centrifugal fan and a casing. The centrifugal fan has blades arranged around the rotation shaft. The casing has a wall part defining an opening. The ring part has a ring shape having a center coinciding with an axis of the rotation shaft. The ring part is provided at first axial ends of the blades and support the blades. The ring part includes an arcuate wall curved in a radially inward of the centrifugal fan. The centrifugal fan is housed in the casing such that the arcuate wall of the ring part is located radially inside of the opening of the wall part.

12 Claims, 12 Drawing Sheets

BLOWER UNIT

CROSS REFERENCE TO RELATED APPLICATION

This application is based on Japanese Patent Applications No. 2007-326316 filed on Dec. 18, 2007 and No. 2008-272922 filed on Oct. 23, 2008, the disclosure of which are incorporated herein by reference.

FIELD OF THE INVENTION

The present invention relates to a blower unit including a centrifugal fan.

BACKGROUND OF THE INVENTION

A blower unit having a centrifugal fan and a scroll casing has been conventionally known. The centrifugal fan includes multiple blades arranged in a circumferential direction of a rotation shaft. The centrifugal fan is provided with a ring part (ring member) having a ring shape defining a center coinciding with an axis of the rotation shaft. The ring part is provided on one axial end of the centrifugal fan, and support the multiple blades. The centrifugal fan is housed in the scroll casing. The scroll casing has an air suction portion defining an air suction opening for introducing air into an inside of the scroll casing on an end with respect to an axial direction of the rotation shaft. Such a blower unit is, for example, described in Japanese Unexamined Patent Application Publication No. 2002-202093, Japanese Patent No. 2940751, and Japanese Patent No. 3351438.

In such a blower unit, the air suction portion of the scroll casing has a bell-mouth wall configured to introduce air from the air suction opening into a radially inner space of the centrifugal fan.

The bell-mouth wall is located on one side of the ring part of the centrifugal fan with respect to the axial direction. In other words, the ring part overlaps the scroll casing, particularly, the air suction portion of the scroll casing in the axial direction. Therefore, it is difficult to reduce the size of the blower unit.

SUMMARY OF THE INVENTION

The present invention is made in view of the foregoing matter, and it is an object of the present invention to provide a blower unit reduced in size.

According to a first aspect of the present invention, a blower unit includes a rotation shaft, a centrifugal fan and a casing. The centrifugal fan is supported by the rotation shaft and housed in the casing. The centrifugal fan includes a plurality of blades and a ring part. The blades are arranged around an axis of the rotation shaft. The ring part is disposed at first axial ends of the blades and support the blades. The ring part has a ring shape having a center coinciding with the axis of the rotation shaft. The casing includes a wall part adjacent to the ring part of the centrifugal fan. The wall part extends in a radial direction of the centrifugal fan and includes an opening portion defining an opening. The ring part includes an arcuate wall having an outside diameter portion at which a diameter of the arcuate wall is the largest and an inside diameter portion at which the diameter of the arcuate wall is the smallest, the outside diameter portion being further than the inside diameter portion from second axial ends of the blades in an axial direction. The arcuate wall is disposed inside of the opening portion of the wall part with respect to the radial direction. The arcuate wall is curved such that a portion between the outside diameter portion and the inside diameter portion is protruded radially inside of the centrifugal fan.

In such a construction, since the arcuate wall of the ring part is disposed inside of the opening portion with respect to the radial direction, it is less likely that the ring part and the casing, particularly, the opening portion of the casing will be overlapped with each other in the axial direction. Accordingly, the blower unit is reduced in size.

Further, the arcuate wall is curved radially inside of the centrifugal fan. That is, the arcuate wall is curved to protrude toward a radially inner space through which air is suctioned in the centrifugal fan. As such, air can be effectively introduced in the radially inner space from the opening by the arcuate wall, even if the casing does not have a bell-mouth portion.

According to a second aspect of the present invention, a blower unit includes an electric motor, a first centrifugal fan, a first casing, a second centrifugal fan and a second casing. The electric motor includes a motor body and a rotation shaft configured to be rotated by the motor body. The rotation shaft has a first shaft portion and a second shaft portion. The first shaft portion and the second shaft portion extend from opposite sides of the motor body. The first centrifugal fan is supported by the first shaft portion, and is housed in the first casing. The second centrifugal fan is supported by the second shaft portion, and is housed in the second casing. The first centrifugal fan includes a plurality of first blades and a first ring part. The first blades are arranged around an axis of the first shaft portion. The first ring part is provided at first axial ends of the first blades and support the first blades. The first ring part has a ring shape having a center coinciding with an axis of the first rotation shaft. The first casing includes a first wall part extending in a radial direction of the first centrifugal fan. The first wall part defines a first opening as a first air suction opening. The second centrifugal fan includes a plurality of second blades and a second ring part. The second blades are arranged around an axis of the second shaft portion. The second ring part is provided at first axial ends of the second blades and supports the second blades. The second ring part has a ring shape having a center coinciding with an axis of the second rotation shaft. The second casing includes a second wall part extending in a radial direction of the second centrifugal fan. The second wall part defines a second opening as a second air suction opening. The first ring part includes a first arcuate wall, and the second ring part includes a second arcuate wall. The first arcuate wall has a first outside diameter portion and a first inside diameter portion, the first outside diameter portion being further than the first inside diameter portion from second axial ends of the first blades in an axial direction of the first shaft portion. The second arcuate wall has a second outside diameter portion and a second inside diameter portion, the second outside diameter portion being further than the second inside diameter portion from second axial ends of the second blades in an axial direction of the second shaft portion. The first arcuate wall is curved radially inside of the first centrifugal fan, and the second arcuate wall is curved radially inside of the second centrifugal fan. The first arcuate wall is located inside of the first opening of the first wall part with respect to the radial direction of the first centrifugal fan. The second arcuate wall is located inside of the second opening of the second wall part with respect to the radial direction of the second centrifugal fan.

In such a construction, since the first and second arcuate walls of the first and second ring parts are located inside of the first and second openings with respect to the radial direction, it is less likely that the first and second ring parts and the first and second casings, particularly, the first and second wall parts will be overlapped with each other in the axial direction. Accordingly, the blower unit is reduced in size.

Further, the first and second arcuate walls are curved radially inside of the first and second centrifugal fans. That is, the first and second arcuate walls are curved to protrude toward radially inner spaces through which air is suctioned into the first and second centrifugal fans. As such, air can be effectively introduced in the radially inner spaces from the first and second openings by the first and second arcuate walls, even if the first and second casings do not have bell-mouth portions.

BRIEF DESCRIPTION OF THE DRAWINGS

Other objects, features and advantages of the present invention will become more apparent from the following detailed description made with reference to the accompanying drawings, in which like parts are denoted by like reference characters and in which.

DETAILED DESCRIPTION OF EXEMPLARY EMBODIMENTS

Figure 1:
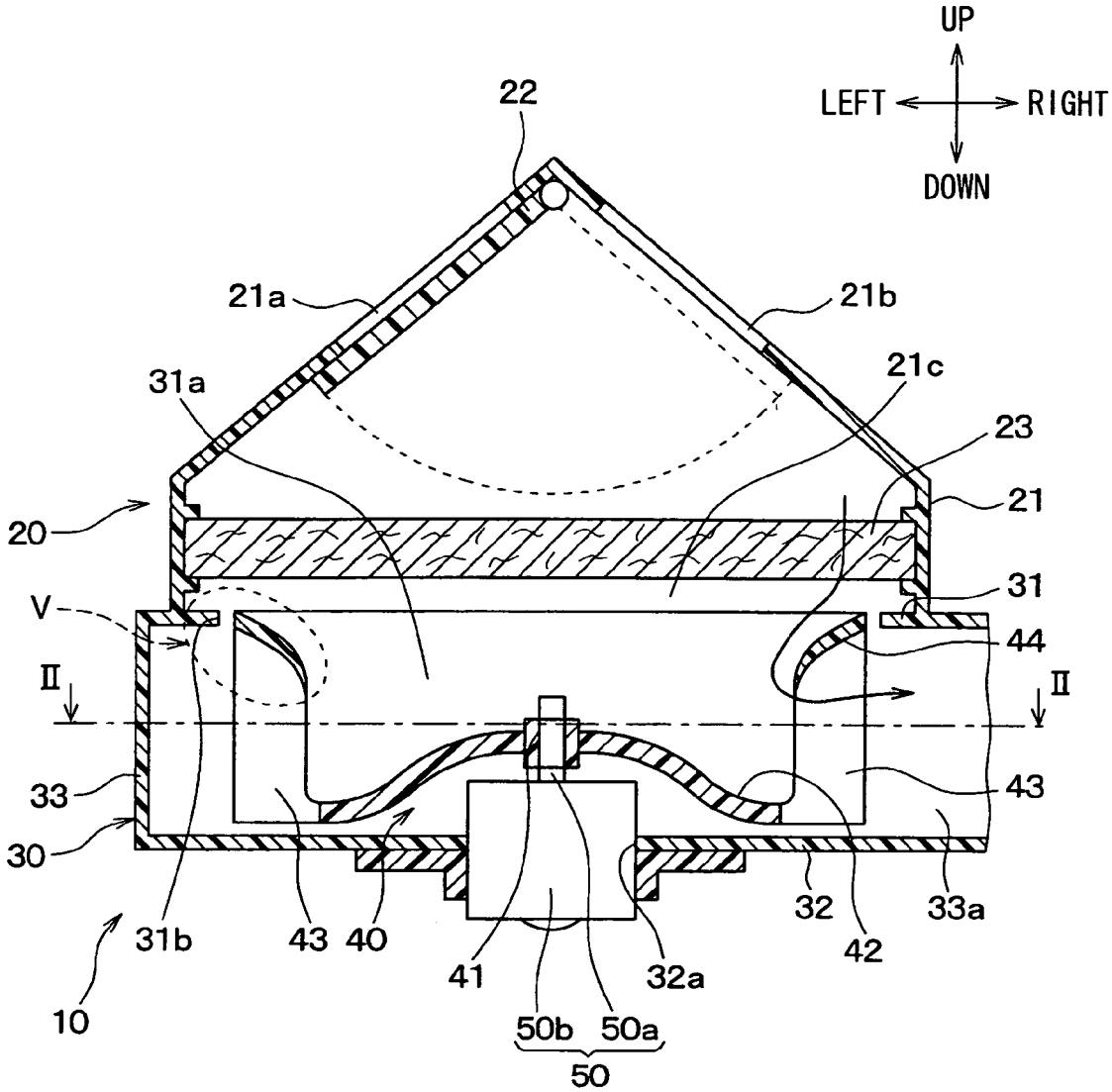
FIG. 1 is a cross-sectional view of a blower unit according to a first embodiment of the present invention.

Exemplary embodiments of the present invention will now be described with reference to the accompanying drawings. Here, like components are denoted by like reference characters and a description thereof is not repeated.

(First Embodiment)

FIG. 1 shows a blower unit 10 of the present embodiment, which is exemplarily used in an air conditioning apparatus for a vehicle. In FIG. 1, up and down arrow and right and left arrow denote directions when the blower unit 10 is mounted in the vehicle.

The blower unit 10 is generally mounted in a space provided inside of an instrument panel at a front part of a passenger compartment of a vehicle. The blower unit 10 constitutes the air conditioning apparatus for a vehicle with an inside/outside air switching device 20 and the like. The blower unit 10 is in communication with the inside/outside air switching device 20. The blower unit 10 draws air from the inside/outside air switching device 20 and blows the air toward a cooling heat exchanger of the air conditioning apparatus. In the embodiment shown in FIG. 1, the blower unit 10 is disposed under the inside/outside air switching device 20.

The inside/outside air switching device 20 generally includes a housing 21, an inside/outside air switching door 22 and a filter 23. The housing 21 has an outside air inlet 21*a*, an inside air inlet 21*b* and an air outlet 21*c*.

The outside air inlet 21*a* is located at a left upper portion of the housing 21 to draw air outside of the passenger compartment of the vehicle into the housing 21. The inside air inlet 21*b* is located at a right upper portion of the housing 21 to draw air inside of the passenger compartment of the vehicle into the housing 21. The air outlet 21*c* is located at a lower side of the housing 21 to introduce the outside air and the inside air toward the blower unit 10.

The switching door 22 is rotatably supported in the housing 21. The switching door 22 is operable to open one of the outside air inlet 21*a* and the inside air inlet 21*b* and to close the other. The filter 23 is disposed between the outside and inside air inlets 21*a*, 21*b* and the air outlet 21*c*. The filter 23 captures impurities and fine particles from the air drawn from the outside and inside air inlets 21*a*, 21*b*.

Next, a structure of the blower unit 10 will be described in detail.

The blower unit 10 generally includes a scroll casing 30 and a centrifugal fan (centrifugal multi blade fan) 40.

The scroll casing 30 forms a blower casing including an upper wall 31, a lower wall 32 and a side wall 33. The upper wall 31 is disposed under the air outlet 21*c* of the casing 21. The upper wall 31 is disposed above a rotation shaft 50*a*, which will be described later. The upper wall 31 constitutes a wall part. The upper wall 31 extends in a radial direction of the fan 40 and has an air suction opening for allowing the air from the air outlet 21*c* of the housing 21 into an air suction space 31*a* of the scroll casing 30. Thus, the air suction space 31*a* is in communication with the air outlet 21*c* through the air suction opening of the upper wall 31, and the air is suctioned from the air outlet 21*c* into the air suction space 31*a*. The air suction space 31*a* provides an opening above the rotation shaft 50*a*.

In the present embodiment, the rotation shaft 50*a* extends in an up and down direction. An upper side of the rotation shaft 50*a* can be referred to as a first axial side and a lower side of the rotation shaft 50*a* can be referred to as a second axial side.

The lower wall 32 is located under the upper wall 31. The lower wall 32 is formed with an opening 32*a*. A motor body 50*b* of an electric motor 50 is fitted in the opening 32*a* of the lower wall 32. Thus, the motor body 50*b* is supported by the lower wall 32. The motor body 50*b* is configured to rotate the rotation shaft 50*a*. The rotation shaft 50*a* extends upwardly from the motor body 50*b*.

Figure 2:
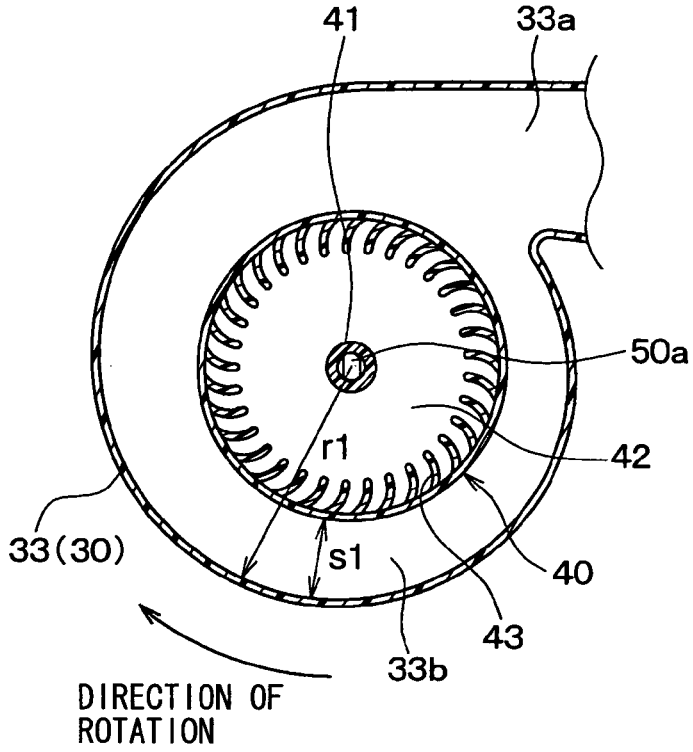
FIG. 2 is a schematic cross-sectional view taken along a line II-II in FIG. 1.

The side wall 33 extends between the upper wall 31 and the lower wall 32. As shown in FIG. 2, the side wall 33 is located on a radially outer side of the rotation shaft 50*a*.

The side wall 33 is configured such that a distance r1 between an axis of the rotation shaft 50*a* and the side wall 33 increases in a direction of rotation of the rotation shaft 50*a* in a scroll manner. In the example of FIG. 2, the rotation shaft 50*a* rotates in a clockwise direction. The scroll casing 30 has an air outlet 33*a* at a location where the distance r1 is the maximum.

The fan 40 is housed inside of the scroll casing 30. The fan 40 includes a boss part 41, a base wall 42, multiple blades 43 and a ring part 44. The boss part 41 is connected to an upper portion of the rotation shaft 50*a*. Thus, the fan 40 is supported by the rotation shaft 50*a*.

Figure 3:
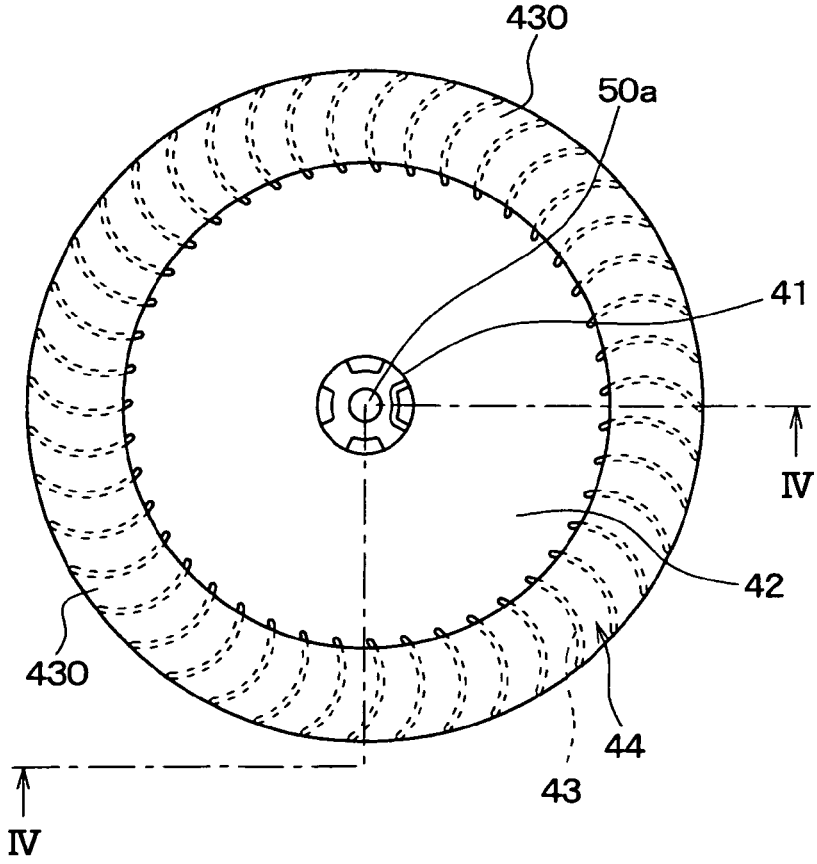
FIG. 3 is an axial end view of a centrifugal fan of the blower unit according to the first embodiment.
Figure 4:
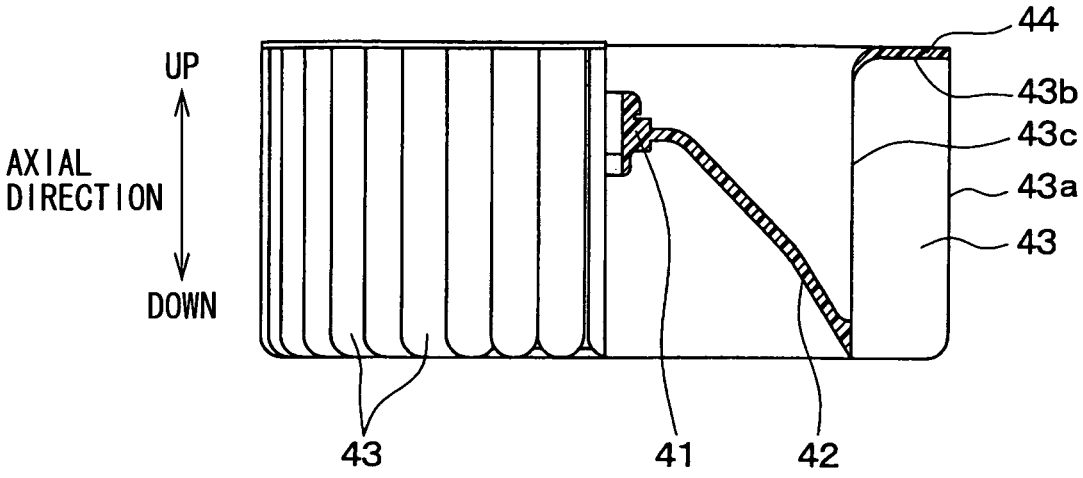
FIG. 4 is a schematic cross-sectional view taken along a line IV-IV in FIG. 3.

FIG. 3 shows the fan 40 when viewed from the top. FIG. 4 shows the fan 40, and partly includes a cross-sectional view.

As shown in FIGS. 3 and 4, the base wall 42 extends from the boss part 41 in a radially outward direction and in a downward direction, over the circumference of the rotation shaft 50*a*.

As shown in FIG. 2, the blades 43 are arranged in a circumferential direction of the rotation shaft 50*a*. Specifically, the blades 43 are arranged at predetermined intervals in the circumferential direction such that air passages 430 are provided between adjacent blades 43. In the example of FIG. 3, the fan 40 has forty-three blades 43 and forty-three air passages 430.

The blades 43 are spaced from an inner surface of the side wall 33 such that an air passage 33*b* is provided between the blades 43 and the side wall 33. Air blown by the fan 40 is conducted toward the air outlet 33*a* through the air passage 33*b*. A radial dimension s1 of the air passage 33*b* increases in the direction of rotation of the rotation shaft 50*a* toward the air outlet 33*a*.

Figure 5:
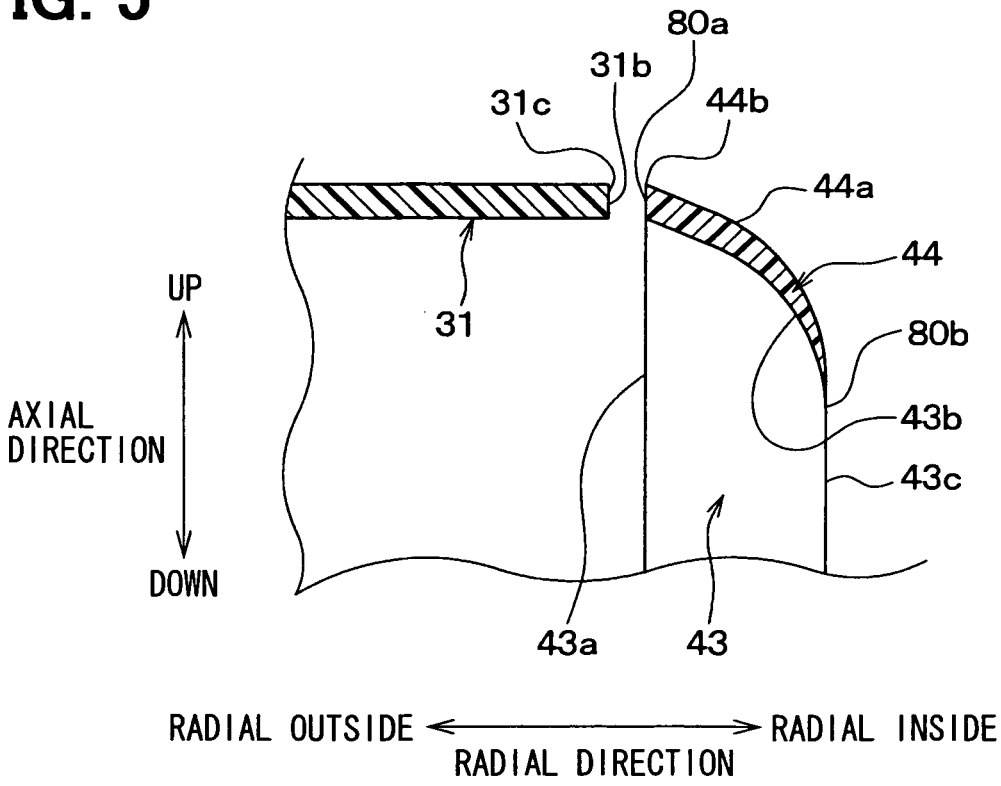
FIG. 5 is an enlarged view of a part V in FIG. 1.

The blades 43 have the identical shape with each other. Second axial ends of the blades 43, such as lower ends in FIG. 4, are supported by the base wall 42. FIG. 5 shows an enlarged view of a part V in FIG. 1.

A radially outer edge 43*a* of each blade 43 extends straight in the axial direction of the rotation shaft 50*a*. An upper edge 43*b* of the blade 43 is located lower than an opening portion 31*b* of the upper wall 31 of the scroll casing 30. The opening portion 31*b* has an annular shape as surrounding the air suction space 31*a*. The upper edge 43*b* of the blade 43*b* is located higher than the rotation shaft 50*a*, and has an arcuate shape projecting radially inside of the fan 40. A radially inner edge 43*c* of the blade 43 extends straight in the axial direction.

As shown in FIGS. 3 and 4, the ring part 44 is provided at first axial ends, such as, upper ends of the blades 43. Specifically, the ring part 44 is provided to cover the upper edges 43*b* of the blades 43 from the top. That is, the ring part 44 is disposed above the blades 43. The ring part 44 is disposed inside of the opening portion 31*b* with respect to the radial direction.

The ring part 44 has a ring shape, and a center of the ring shape coincides with the axis of the rotation shaft 50*a*, as shown in FIG. 3.

Specifically, as shown in FIG. 5, the ring part 44 includes an arcuate wall 44*a* having an arcuate shape in a cross-section defined in the axial direction. The arcuate wall 44*a* is disposed inside of the opening portion 31*b* with respect to the radial direction. The arcuate wall 44*a* includes a maximum diameter portion (outside diameter portion) 80*a* at which a radial dimension of the arcuate wall 44*a* is the maximum and a minimum diameter portion (inside diameter portion) 80*b* at which a radial dimension of the arcuate wall 44*a* is the minimum. The maximum diameter portion 80*a* is located higher than the minimum diameter portion 80*b* with respect to the axial direction.

Here, the maximum diameter portion 80*a* is a portion where the arcuate wall 44*a* has the maximum diameter with respect to the radial direction that is perpendicular to the axis of the rotation shaft 50*a*. The minimum diameter portion 80*b* is a portion where the arcuate wall 44*a* has the minimum diameter with respect to the radial direction.

The air suction space 31*a* is provided radially inside of the arcuate wall 44*a*, and air is introduced in the radially inside of the fan 40 through the air suction space 31*a*. The arcuate wall 44*a* is curved such that the portion between the maximum diameter portion 80*a* and the minimum diameter portion 80*b* is protruded toward the air suction space 31*a*, such as, toward the radially inside of the fan 40.

An uppermost end 44*b* of the ring part 44 coincides with an uppermost end 31*c* of the opening portion 31*b* with respect to the axial direction. The uppermost end 44*b* is the furthest portion in the ring part from the lower ends of the blades 43 with respect to the axial direction, and the uppermost end 31*c* is the furthest portion in the opening portion 31*b* from the lower ends of the blades 43 with respect to the axial direction.

An upper side of the ring part 44 coincides with an upper side of the opening portion 31*b* of the upper wall 31 with respect to the axial direction. In other words, the uppermost end 44*b* of the ring part 44 and the uppermost end 31*c* of the opening portion 31*b* of the upper wall 31 are located on the same plane (imaginary plane), which is perpendicular to the rotation shaft 50*a*.

The ring part 44 supports the upper portions of the blades 43. Thus, the ring part 44 restricts the blades 43 from expanding due to a centrifugal force caused by rotation of the rotation shaft 50*a*.

In the present embodiment, the boss part 41, the base wall 42, the blades 43 and the ring part 44 are integrally formed of a resin, for example.

Next, an operation of the present embodiment will be described.

When the fan 40 is rotated by the electric motor 50, the air is suctioned from the air outlet 21*c* into the air suction space 31*a* provided radially inside of the arcuate wall 44*a* of the ring part 44. At this time, the air is introduced toward the radially inner sides of the blades 43 by the arcuate wall 44*a* of the ring part 44. The air is then blown out in the radially outer sides of the blades 43 through the air passages 430. The air blown by the fan 40 is introduced to the air outlet 33*a* through the air passage 33*b* and is blown out from the scroll casing 30.

In the present embodiment, the uppermost end 44*b* of the ring part 44 coincides with the uppermost end 31*c* of the opening portion 31*b* of the upper wall 31 with respect to the axial direction. Further, the arcuate wall 44*a* of the ring part 44 is located radially inside of the opening portion 31*b*. As such, the arcuate wall 44*a* is avoided overlapping the scroll casing 30, particularly, the upper wall 31 defining the air suction opening in the axial direction. Accordingly, the size of the blower unit 10 can be reduced.

Further, the air can be introduced toward the radially inner sides of the blades 43 by the arcuate wall 44*a* of the ring part 44. That is, the air suctioned from the air outlet 21*c* can be effectively introduced into the radially inner space of the fan 40, even when the scroll casing 30 does not have a bell-mouth portion.

The ring part 44 is disposed radially inside of the air suction opening of the upper wall 31. Therefore, if the dimension of the blower unit 10 in the axial direction is limited, the length of the blades 43 in the axial direction can be flexibly decided. Accordingly, flexibility in designing is improved, as compared with a case where the fan 40 is arranged such that the ring part 44 overlaps a wall of the scroll casing 30 in the axial direction.

In such a case, a ratio of the axial dimension of the fan 40 to the diameter of the fan 40 can be flexibly decided. Therefore, the ratio of the axial dimension of the fan 40 to the diameter of the fan 40 can be optimally set so as to improve fan efficiency.

In the embodiment shown in FIG. 5, the ring part 44 is disposed to cover the upper edges 43*b* of the blades 43 from the top. However, the ring part 44 can be modified. For example, as shown in FIG. 6, the ring part 44 can be disposed to cover radially outer portions of the upper edges 43*b* of the blades 43.

In the embodiment shown in FIG. 5, each blade 43 has the radially inner edge 43*c* that extends straight in a direction parallel to the axis of the rotation shaft 50*a*. However, the shape of the blade 43 can be modified. For example, as shown in FIG. 7, the blade 43 can have the radially inner edge 43*c* that extends in an inclined manner with respect to the axis of the rotation shaft 50*a* such that a radial dimension t1 of the blade 43 increases as a function of distance from the ring part 44.

Figure 6:
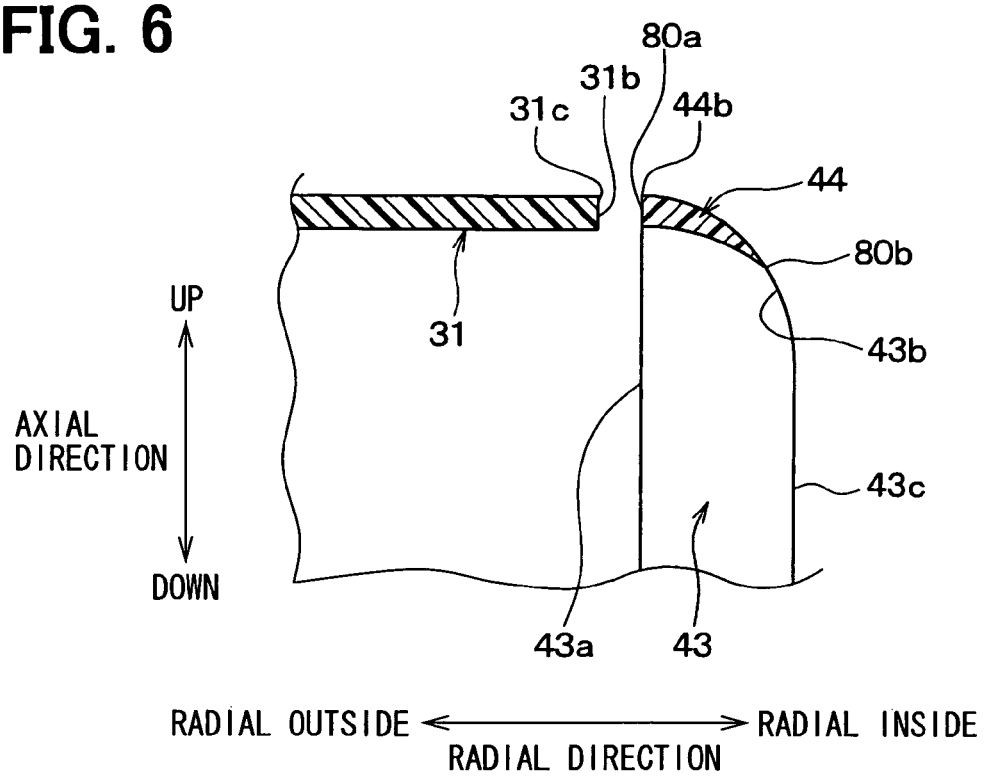
FIG. 6 is an enlarged cross-sectional view of the part of the blower unit according to a first modification of the first embodiment.
Figure 7:
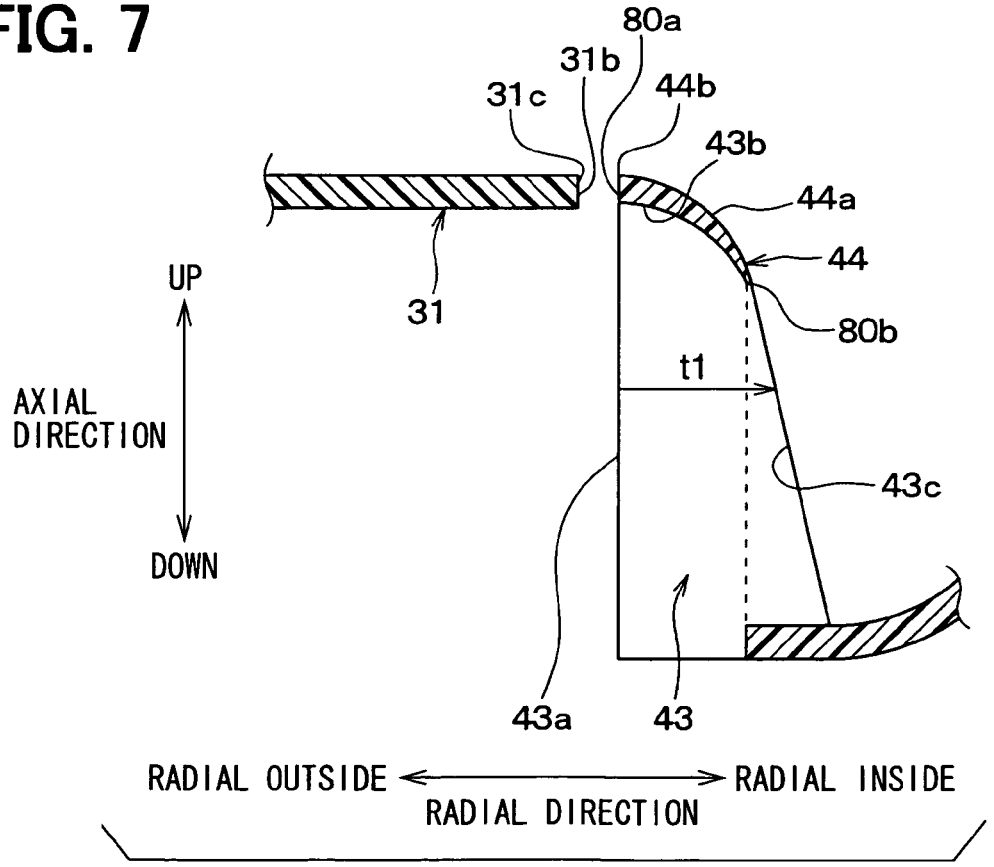
FIG. 7 is an enlarged cross-sectional view of the part of the blower unit according to a second modification of the first embodiment.
Figure 17A:
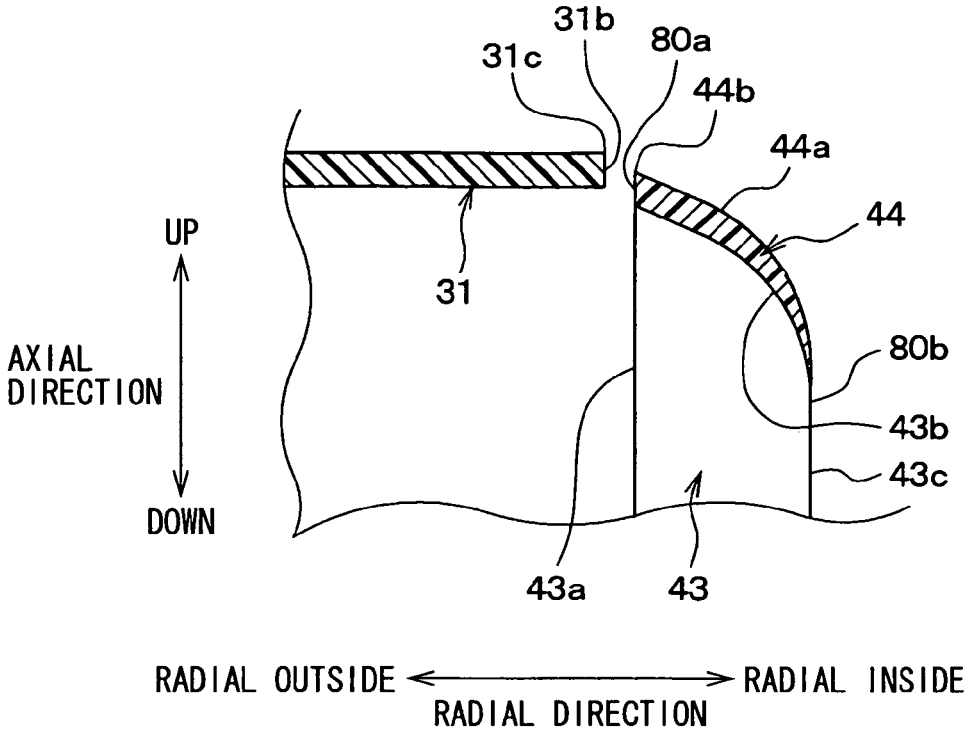
FIG. 17A is an enlarged cross-sectional view of the part of the blower unit according to a third modification of the first embodiment.

In the embodiments shown in FIGS. 5 to 7, the uppermost end 44*b* of the ring part 44 is disposed to coincide with the uppermost end 31*c* of the opening portion 31*b* of the upper wall 31 with respect to the axial direction of the rotation shaft 50*a*. Alternatively, the uppermost end 44*b* of the ring part 44 can be disposed lower than the uppermost end 31*c* of the opening portion 31*b* of the upper wall 31 with respect to the axial direction of the rotation shaft 50*a*, as shown in FIG. 17A.

(Second Embodiment)

In the second embodiment, the blower unit 10 has a structure for restricting air from flowing outside of the scroll casing 30 through a gap between the opening portion 31*b* of the upper wall 31 and the ring part 44.

Figure 8:
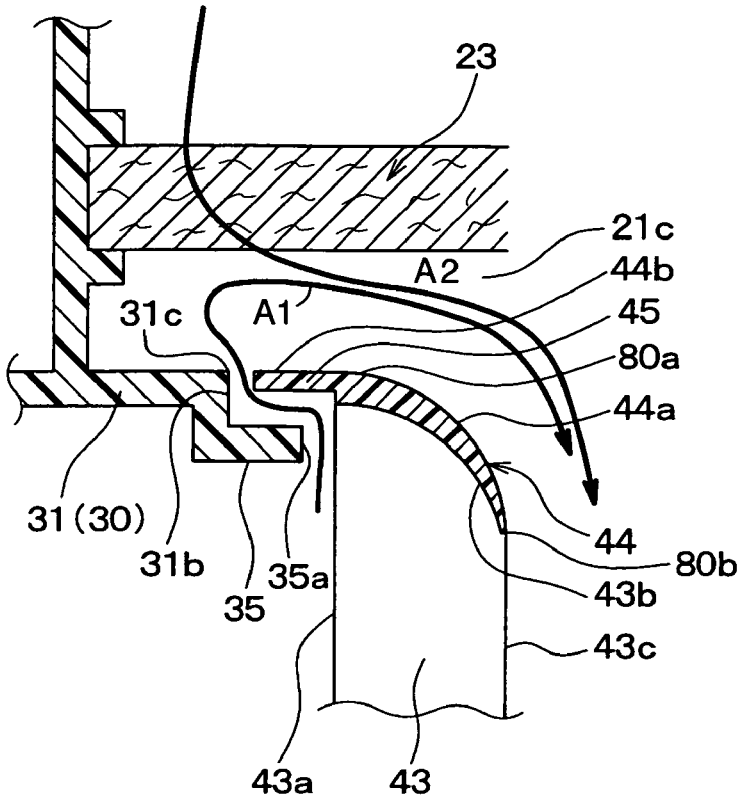
FIG. 8 is a schematic cross-sectional view of a part of a blower unit according to a second embodiment of the present invention.

FIG. 8 shows an enlarged view around the upper wall 31 of the scroll casing 30 and the ring part 44.

The upper wall 31 of the scroll casing 30 has a projection 35 projecting from the opening portion 31*b* toward the blades 43. The projection 35 is provided over an inner circumference of the opening portion 31*b*, that is, throughout in the circumferential direction of the rotation shaft 50*a*. An end of the projection 35 provides an opening portion 35*a* defining an opening. The projection 35 is opposed to the radially outer edges 43*a* of the blades 43 across a clearance. The projection 35 provides a clearance for restricting air from flowing through the clearance provided between itself and the radially outer edges 43*a* of the blades 43. The projection 35 forms a labyrinthine sealing structure as a throttle part for restricting the air from flowing through the clearance between the opening portion 31*b* and the ring part 44, together with the blades 43.

The ring part 44 has a projection 45 over an outer circumference thereof, that is, throughout in the circumferential direction of the rotation shaft 50*a*. The projection 45 projects toward the opening portion 31*b* of the upper wall 31. The projection 45 is opposed to the opening portion 31*b* across the clearance. The projection 45 is located above the projection 35. That is, the projection 45 is displaced from the projection 35 in the axial direction of the rotation shaft 50*a*.

The projection 45 forms the labyrinthine sealing structure as the throttle part together with the opening portion 31*b* of the upper wall 31 for restricting the air from flowing through the clearance between the opening portion 31*b* and the projection 45.

Since the labyrinthine sealing structure is provided as above, the flow of air toward the outside of the scroll casing 30 through the clearance between the opening portion 31*b* and the ring part 44 while bypassing the air outlet 33*a* can be reduced.

Here, the opening portion 31*b* forms a large diameter portion of the air suction opening of the upper wall 31, and the opening portion 35*a* forms a small diameter portion of the air suction opening of the upper wall 31. That is, a diameter of the opening provided by a radially inner end of the opening portion 31*b* is larger than a diameter of the opening provided by the end 35*a* of the projection 35.

In other words, the diameter of the air suction opening of the upper wall 31 is the largest at the opening portion 31*b* and is the smallest at the opening portion 35*a*.

In the present embodiment, since the labyrinthine sealing structure restricts the air from flowing through the clearance between the opening portion 31*b* of the upper wall 31 and the ring part 44, the amount of air blown out from the air outlet 33*a* can be increased.

Even if the air flows through the clearance between the upper wall 31 and the ring part 44 as shown by an arrow A1, the air is directed toward the radially inside of the fan 40 by being collided with the filter 23. Thus, the air (A1) can be suctioned in the radially inner sides of the blades 43 with the air (A2) passing through the filter 23. Accordingly, it is less likely that the air will leak to the outside of the blower unit 10.

In the embodiment shown in FIG. 8, the labyrinthine sealing structure is constructed of the projection 35 of the upper wall 31 of the scroll casing 30 and the projection 45 of the ring part 44. However, the labyrinthine sealing structure can be modified in various ways, for example, as shown in FIGS. 9 and 10.

Figure 9:
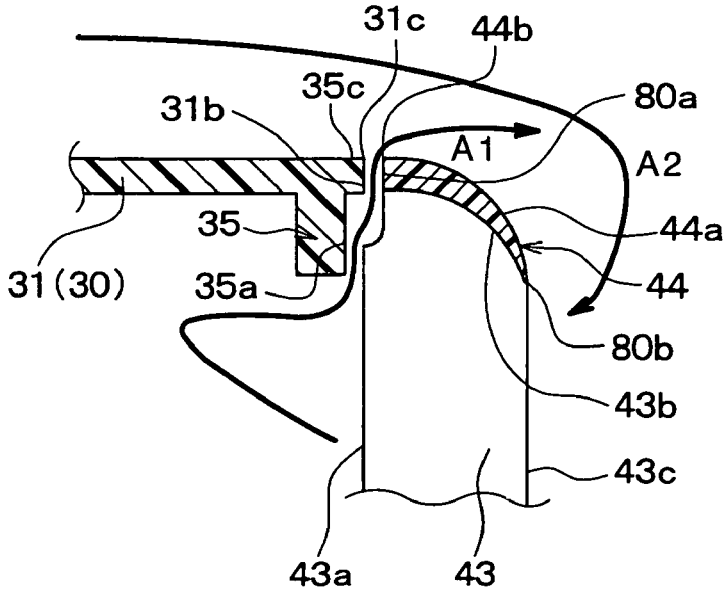
FIG. 9 is a schematic cross-sectional view of the part of the blower unit according to a first modification of the second embodiment.
Figure 10:
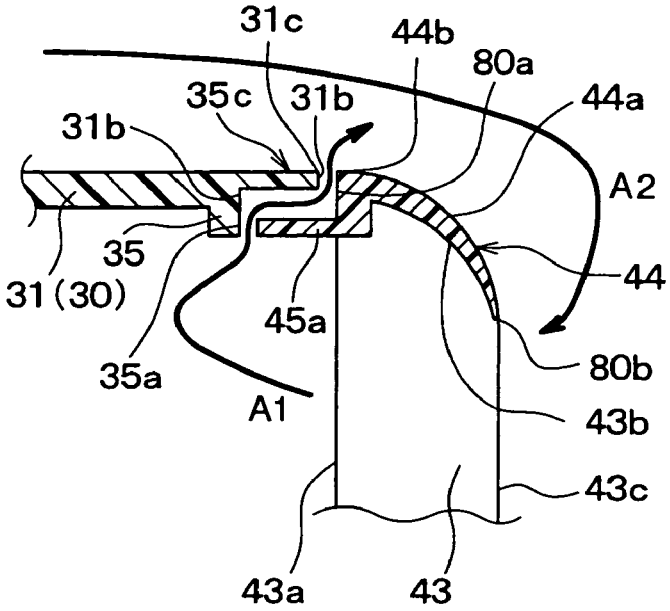
FIG. 10 is a schematic cross-sectional view of the part of the blower unit according to a second modification of the second embodiment.

In a modification shown in FIG. 9, the upper wall 31 of the scroll casing 30 has a projection 35*c* projecting toward the ring part 44. The projection 35*c* is formed over the circumference of the air suction opening. The projection 35*c* and the ring part 44 constitute the labyrinthine sealing structure as the throttle part for restricting the air from flowing through the clearance between the upper wall 31 and the ring part 44.

In the example shown in FIG. 9, the projection 35 projects from the upper wall 31 in a direction intersecting the radial direction. For example, the projection 35 projecting in the downward direction.

Here, the opening portion 31*b* forms the small diameter portion of the air suction opening of the upper wall 31. The opening portion 35*a* forms the large diameter portion of the air suction opening of the upper wall 31. The small diameter portion is located radially outside of the arcuate wall 44*a* of the ring part 44. In other words, the arcuate wall 44*a* of the ring part 44 is disposed radially inside of the small diameter portion.

A radially inner surface of the projection 35*c* forms the opening portion 31*b*. A radially inner surface of the projection 35 forms the opening portion 35*a*.

In a modification shown in FIG. 10, the ring part 44 can be provided with a projection 45*a* projecting toward the projection 35 of the upper wall 31, thereby to provide a clearance for restricting the air from flowing between the projection 45*a* and the projection 35. Thus, the projection 45*a* and the projection 35 constitute the labyrinthine sealing structure as the throttle part for restricting the air from flowing through the clearance between the upper wall 31 and the ring part 44.

(Third Embodiment)

In the third embodiment, the blower unit 10 has a structure for restricting the air blown by the blades 43 in the radially outward direction from flowing back into the air passages 430.

Figure 11:
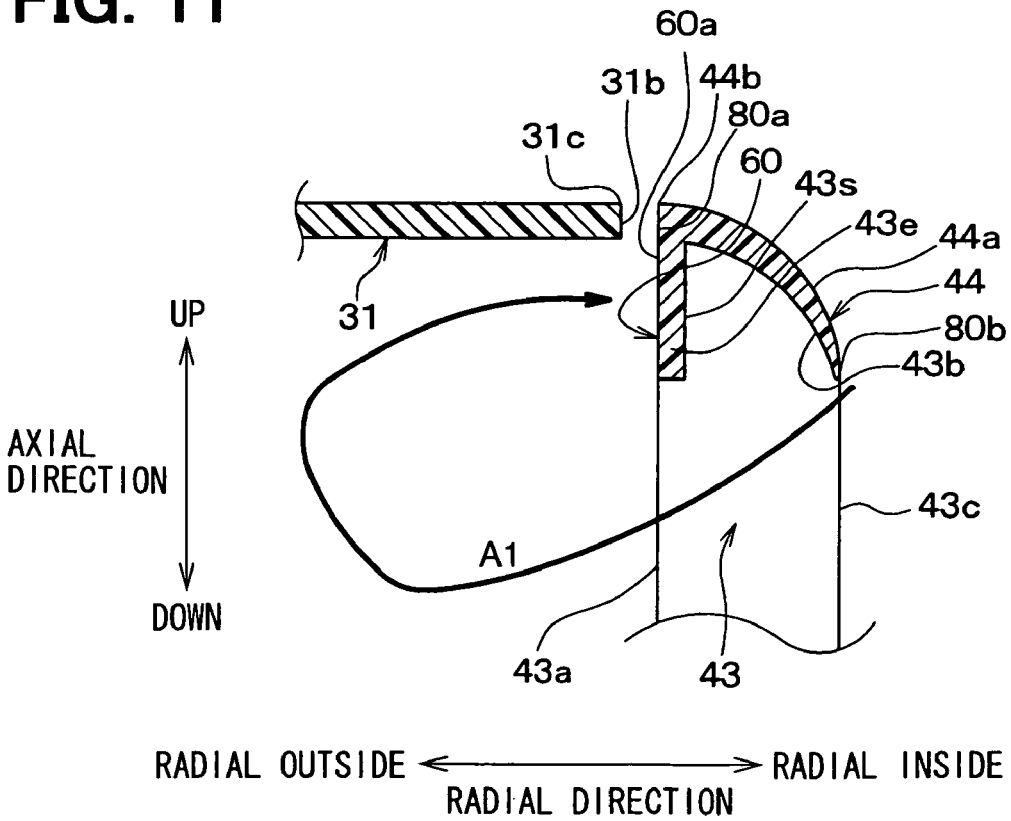
FIG. 11 is a schematic cross-sectional view of a part of a blower unit according to a third embodiment of the present invention.

FIG. 11 shows an upper end of the blade 43, corresponding the portion denoted by the dashed line V in FIG. 1.

In the present embodiment, the blower unit 10 is provided with a fan outer rib 60 as an air blocking part for restricting the air from flowing back into the air passages 430 of the blades 43, in addition to the ring part 44 having the structure similar to the embodiment shown in FIGS. 5-7, 17A and 17B.

The fan outer rib 60 is disposed adjacent to the ring part 44 with respect to the axial direction. For example, the fan outer rib 60 is disposed under the ring part 44. The fan outer rib 60 is disposed on the radially outer side of the blades 43. The fan outer rib 60 has a ring shape having a center coinciding with the axis of the rotation shaft 50*a*.

Each of the blades 43 is formed with a recessed portion 43*e* on its upper and radially outer portion. The recessed portion 43*e* is recessed in the radially inward direction from the radially outer edge 43*a*. A bottom 43*s* of the recessed portion 43*e* forms a radially outer edge of the upper portion of the blade 43, and is parallel to the axis of the rotation shaft 50*a*.

The fan outer rib 60 is disposed radially inside of the opening portion 31*b* of the upper wall 31 of the scroll casing 30. The fan outer rib 60 is received in the recessed portions 43*e* of the blades 43. The fan outer rib 60 is configured to extend along the radially outer edges 43*s* of the blades 43. A radially outer surface 60*a* of the fan outer rib 60 is parallel to the axis of the rotation shaft 50*a*.

The radially outer edge 43*a* of the blade 43, which is under the recessed portion 43*e*, is parallel to the axis of the rotation shaft 50*a*. The radially outer surface 60*a* of the fan outer rib 60 is coincident with the radially outer edges 43*a* of the blades 43 with respect to the radial direction.

In the present embodiment, the fan outer rib 60 and the ring part 44 are integrally formed of a resin.

The air suctioned in the air suction space 31*a* by the rotation of the fan 40 is blown from the radially inner sides of the blades 43 toward the radially outer sides of the blades 43. A part of the air blown by the fan 40 collides with the upper, lower and side walls 31, 32, 33 in the air passage 33*b* of the scroll casing 30, and thus returns toward the blades 43, as shown by an arrow A1 in FIG. 11. In such a case, the fan outer rib 60 blocks the air from flowing back into the air passages 430 provided between the adjacent blades 43.

In the present embodiment, the fan outer rib 60 is provided on the radially outer sides of the blades 43. The fan outer rib 60 has the ring shape having the center coinciding with the axis of the rotation shaft 50*a*. Therefore, the fan outer rib 60 restricts the air blown by the blades 43 in the radially outward direction from entering the air passages 430.

Since the fan outer rib 60 restricts the entry of the return air flow into the air passages 430, it is less likely that the air blown out in the radially outward direction by the rotation of the blades 43 will be disturbed.

Accordingly, the air flow in the radially outward direction by the rotation of the blades 43 is efficiently generated. That is, the fan efficiency is improved.

The blower unit 10 of the third embodiment can be modified in various ways. FIGS. 12 to 16 show various modifications of the blower unit 10 of the third embodiment.

Figure 12:
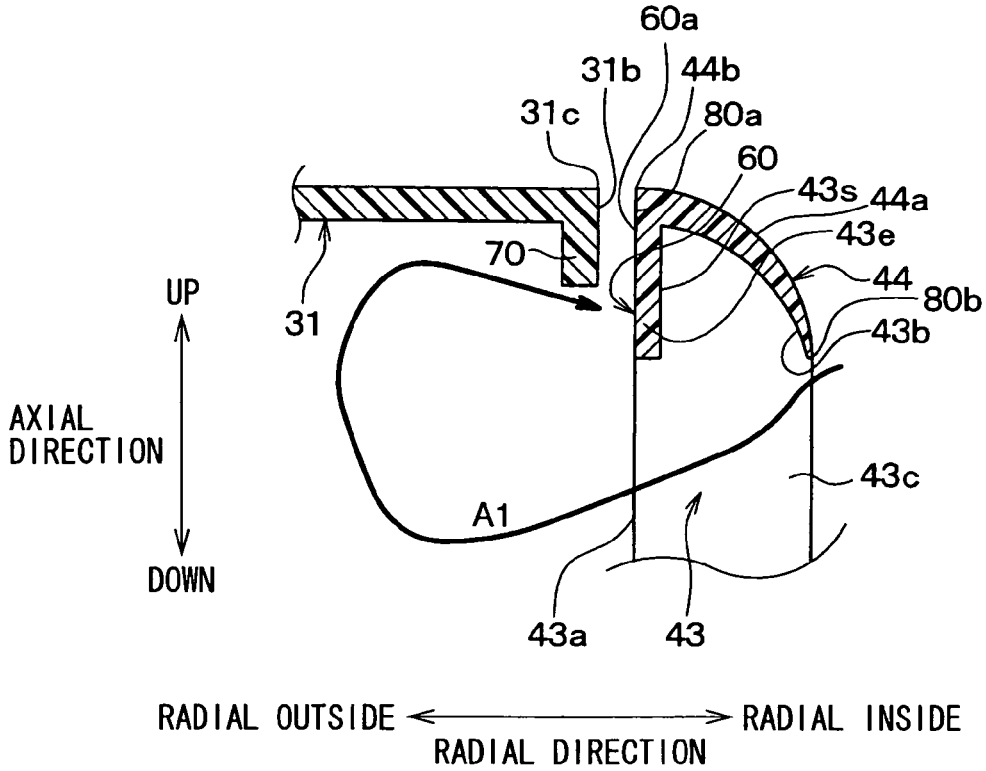
FIG. 12 is a schematic cross-sectional view of the part of the blower unit according to a first modification of the third embodiment.

(1) As shown in FIG. 12, the scroll casing 30 can have a projection 70 for restricting the air from flowing back to the air passages 430. The projection 70 projects from the opening portion 31*b* of the upper wall 31 in the downward direction. The projection 70 has a ring shape having a center coincident with the axis of the rotation shaft 50*a*. Thus, the projection 70 overlaps the fan outer rib 60 with respect to the radial direction.

Accordingly, as shown by the arrow A1 in FIG. 12, it is less likely that the air, which is blown out in the radially outward direction and is directed toward the blades 43, will enter the air passages 430.

Figure 13:
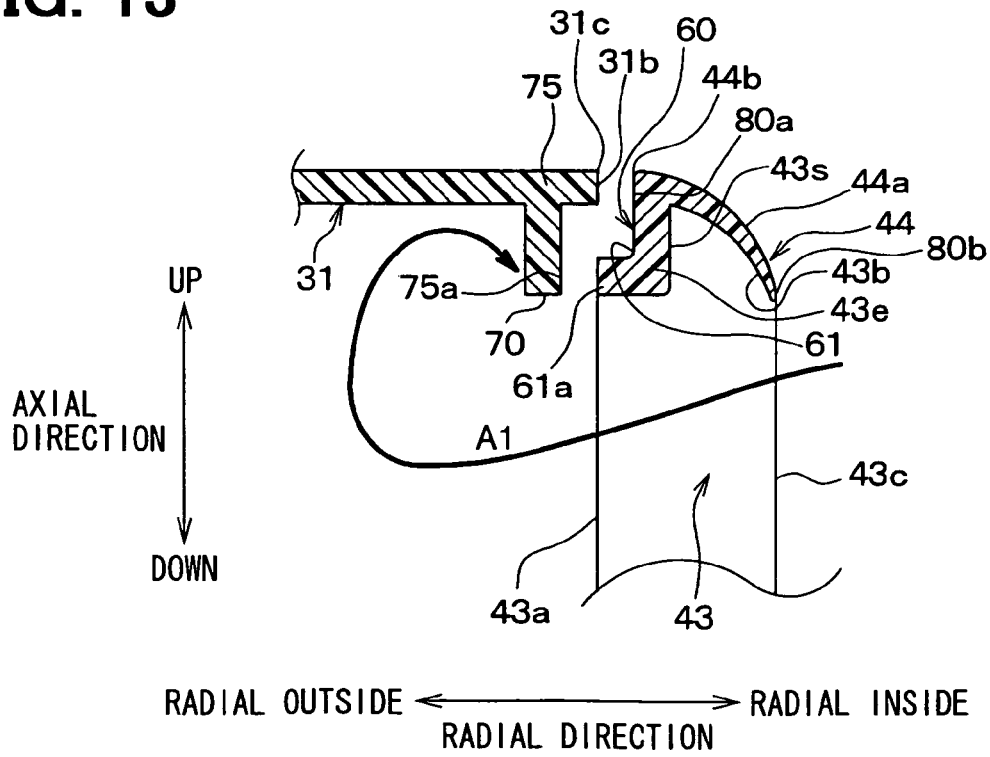
FIG. 13 is a schematic cross-sectional view of the part of the blower unit according to a second modification of the third embodiment.

(2) As shown in FIG. 13, the scroll casing 30 can have a projection 75 at the opening portion 31*b* of the upper wall 31, in addition to the projection 70. The projection 75 projects in the radially inward direction.

Here, the projection 75 and a radially outer wall of the ring part 44 constitute the labyrinthine sealing structure as the throttle part for restricting the air from flowing through the clearance between the upper wall 31 and the ring part 44, such as, between the projection 75 and the radially outer wall of the ring part 44.

In addition, the projection 70 and a projection 61*a* of the fan outer rib 60 constitute the labyrinthine sealing structure as the throttle part for restricting the air from flowing through the clearance between the upper wall 31 and the ring part 44, such as, between the projection 70 and the projection 61*a*. The projection 61*a* projects from a lower end of the fan outer rib 60 in the radially outward direction.

In the example shown in FIG. 13, the fan outer rib 60 is formed with a recessed portion 61 that is recessed in the radially inward direction.

Here, the opening portion 31*b* of the upper wall 31 forms the small diameter portion of the air suction opening of the upper wall 31. The opening portion 31*b* of the upper wall 31 is provided by a radially inner surface of the projection 75. A radially inner surface of the projection 70 forms an opening portion 75*a*. The opening portion 75*a* forms the large diameter portion of the air suction opening of the upper wall 31.

Figure 14:
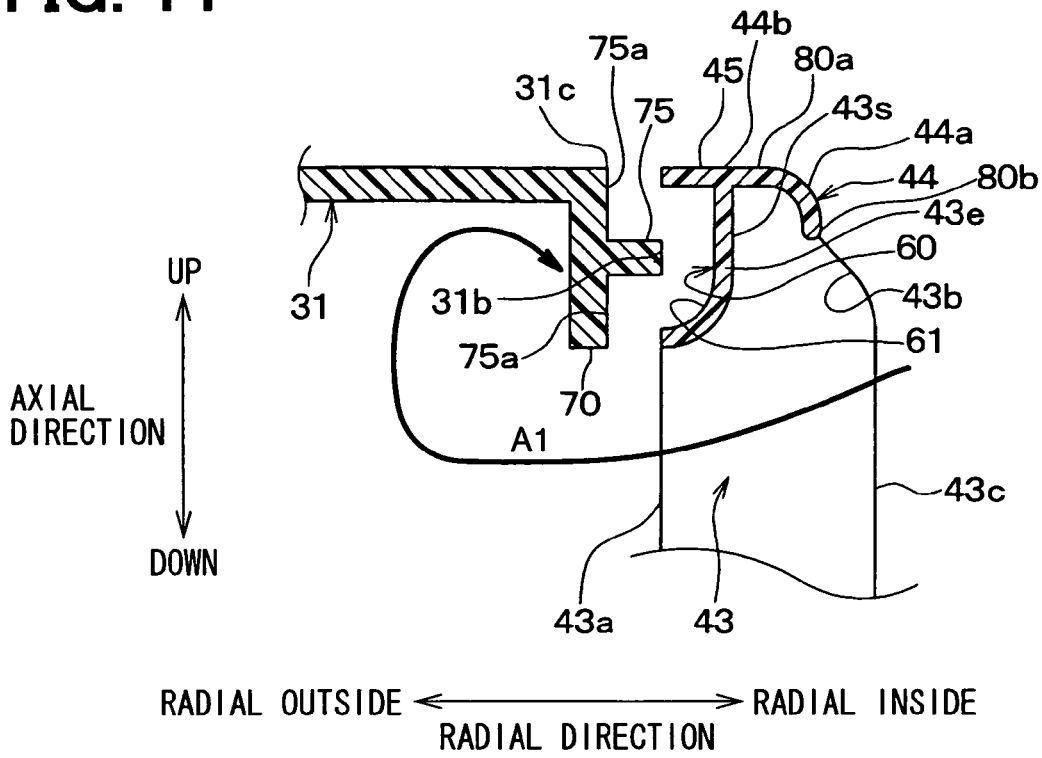
FIG. 14 is a schematic cross-sectional view of the part of the blower unit according to a third modification of the third embodiment.

(3) As shown in FIG. 14, the ring part 44 can be provided with the projection 45 projecting in the radially outward direction, and the projection 75 can be formed to project from the projection 70 in the radially inward direction. In such a case, the projections 70, 75, the fan outer rib 60 and the projection 45 constitute the labyrinthine sealing structure as the throttle part for restricting the air from flowing through the clearance between the opening portion 31*b* and the ring part 44.

In the example shown in FIG. 14, the fan outer rib 60 is formed with the recessed portion 61 recessed in the radially inward direction. A lower end of the recessed portion 61 has an arcuate shape. A lower portion of the fan outer rib 60 has an arcuate shape curved in the radially inward direction and in the downward direction. Accordingly, the fan outer rib 60 can guide the air being blown in the radially outward direction by the blades 43 toward a generally downward direction. In other words, the fan outer rib 60 can tilt the air flow direction. In addition, the ring part 44 is disposed at upper portions of the upper edges 43*b* of the blades 43.

Figure 15:
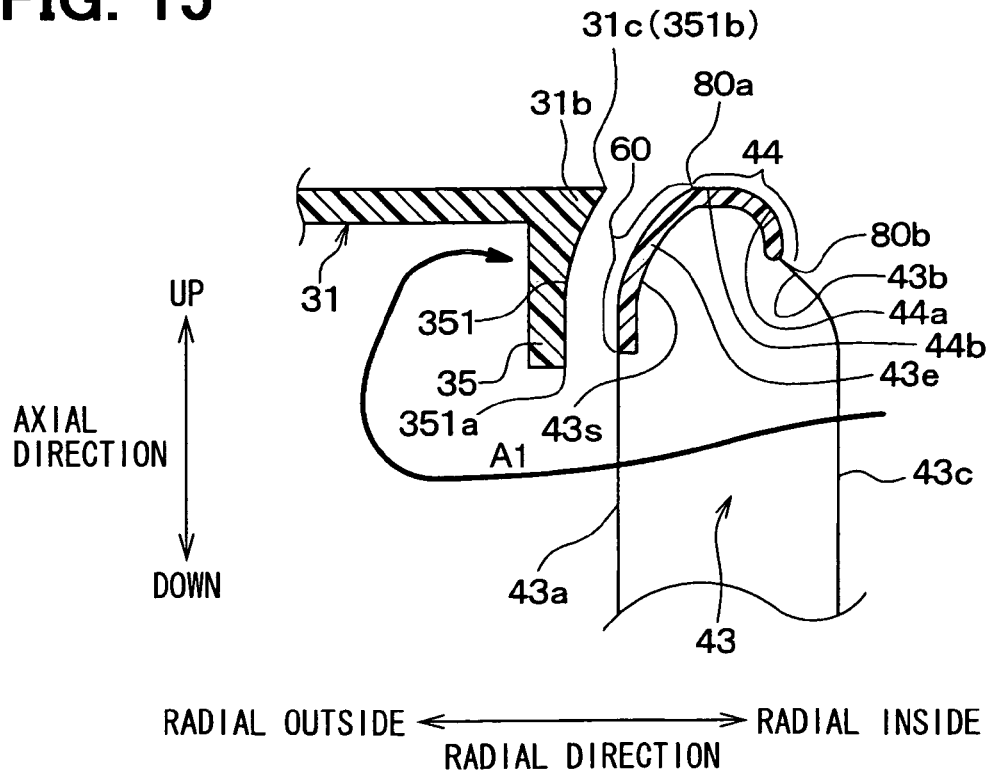
FIG. 15 is a schematic cross-sectional view of the part of the blower unit according to a fourth modification of the third embodiment.

(4) As shown in FIG. 15, the fan outer rib 60 can includes an arcuate portion at its upper portion, the arcuate portion being curved in the radially outward direction. Here, the fan outer rib 60 is provided in the recessed portions 43*e* formed in the upper portions of the blades 43.

The bottom 43*s* of the recessed portion 43*e* forms the radially outer edge surface of the upper portion of the blade 43. The radially outer edge surface 43*s* has an arcuate shape curved in the radially outward direction. The fan outer rib 60 is configured to extend along the radially outer edge surfaces 43*s* of the blades 43. In the example shown in FIG. 15, the upper wall 31 of the scroll casing 30 has the projection 35. The projection 35 has a radially inner surface 351, an upper portion of which is curved into an arcuate shape in the radially outward direction.

Here, the radially inner surface 351 of the projection 35 forms the air suction opening of the upper wall 31. A lowermost portion of the radially inner surface 351 forms a large diameter portion 351*a* of the air suction opening of the upper wall 31. An uppermost portion of the radially inner surface 351 forms a small diameter portion 351*b* of the air suction opening of the upper wall 31. The diameter of the air suction opening is the smallest at the small diameter portion 351*b* and is the largest at the large diameter portion 351*a*. The radially inner surface 351 of the projection 35 is displaced from the fan outer rib 60 in the radial direction.

Figure 16:
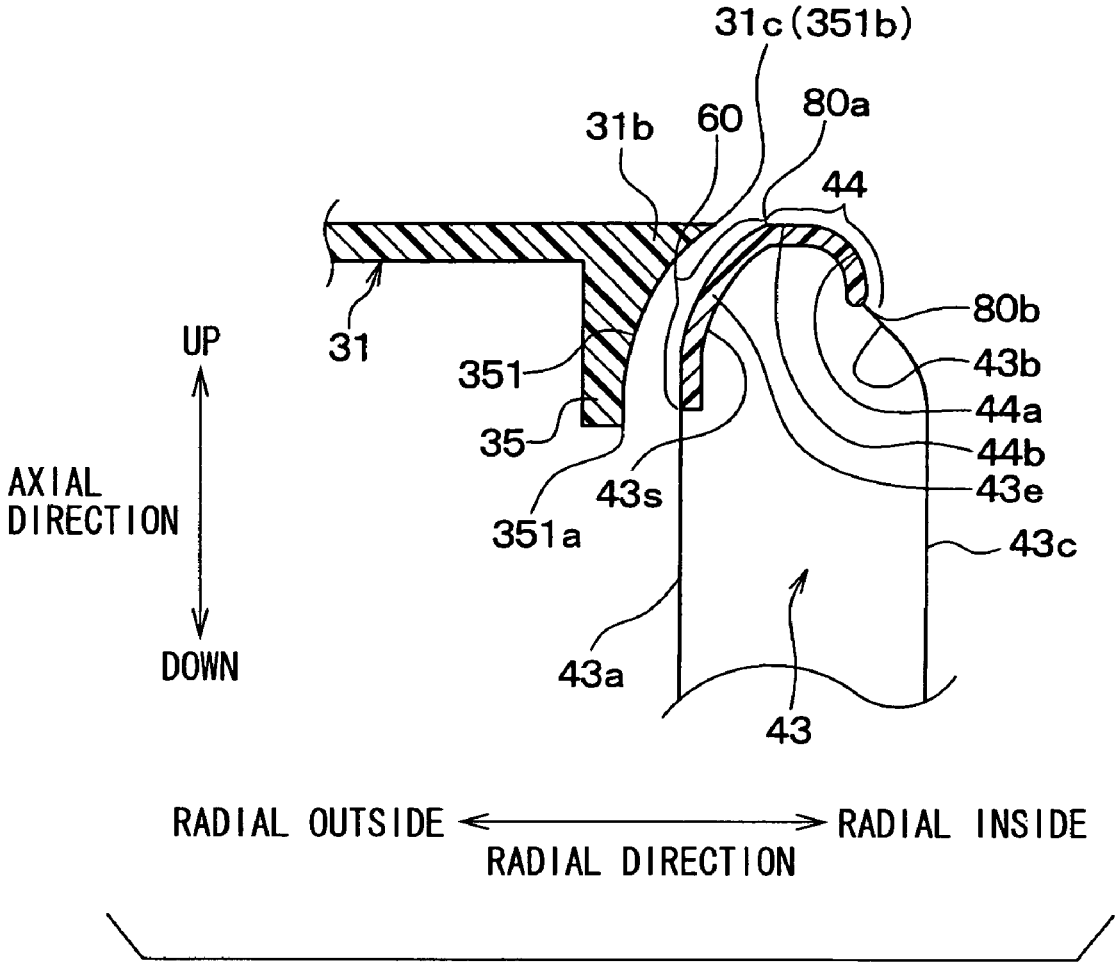
FIG. 16 is a schematic cross-sectional view of the part of the blower unit according to a fifth modification of the third embodiment.

As shown in FIG. 16, the projection 35 can be configured such that the radially inner surface 351 overlaps the fan outer rib 60 with respect to the axial direction.

In such a case, the arcuate wall 44*a* of the ring part 44 is located radially inside of the small diameter portion 351*b*.

Figure 17B:
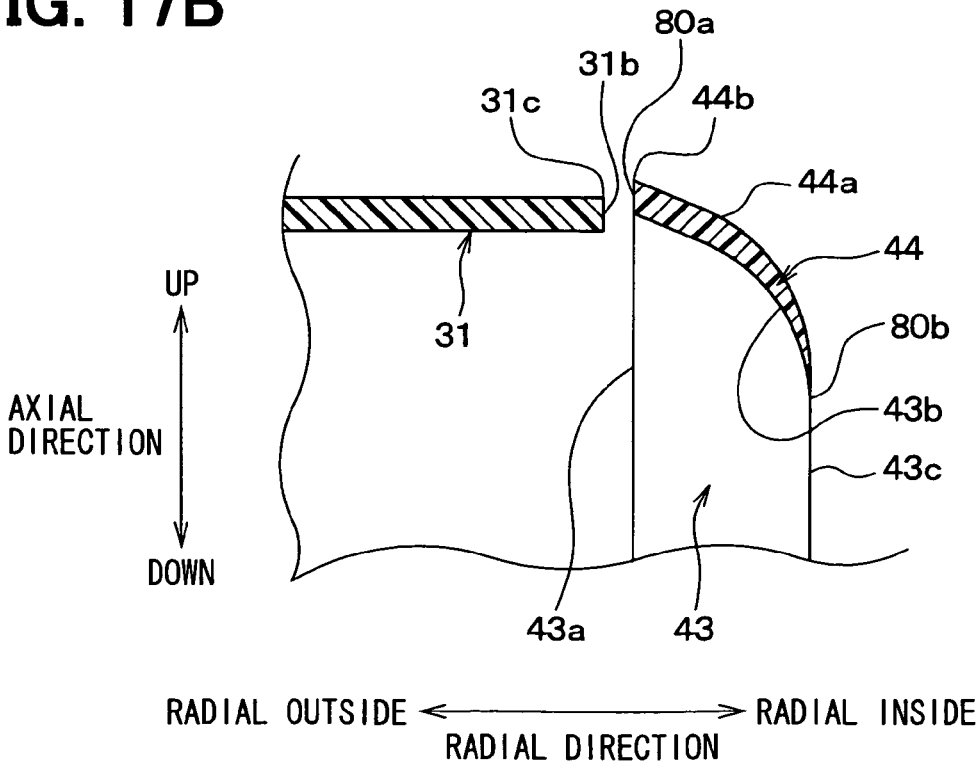
FIG. 17B is a schematic cross-sectional view of the part of the blower unit according to a fourth modification of the first embodiment.

FIG. 17B shows another modification of the blower unit 10. As shown in FIG. 17B, the uppermost end 31*c* of the opening portion 31*b* of the upper wall 31 can be located lower than the uppermost end 44*b* of the ring part 44.

(Fourth Embodiment)

Figure 18:
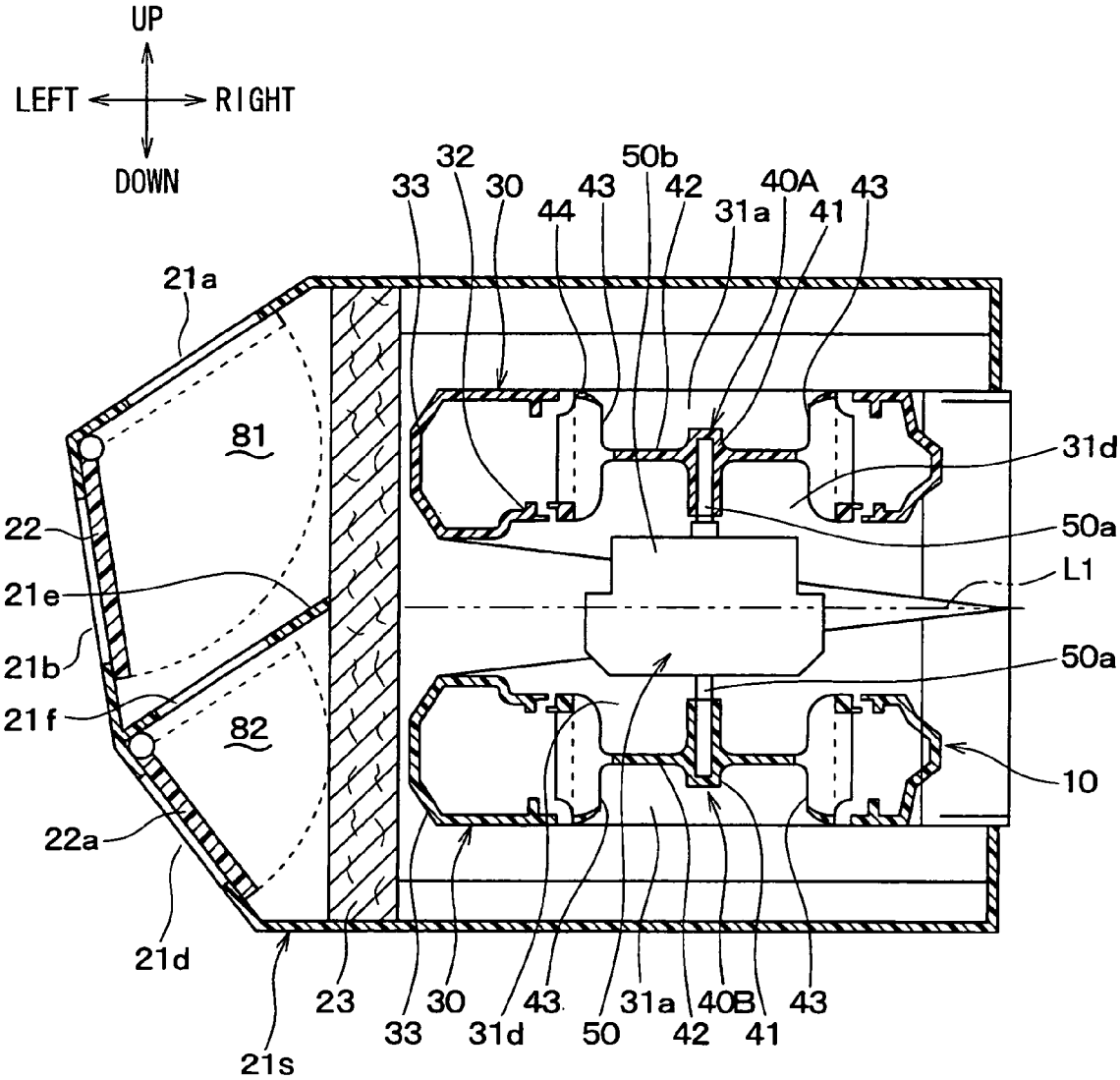
FIG. 18 is a cross-sectional view of a blower unit according to a fourth embodiment of the present invention.

Referring to FIG. 18, the blower unit 10 of the fourth embodiment has centrifugal fans on opposite ends of the rotation shaft 50*a* extending in the up and down direction from the motor body 50*b*.

Figure 19:
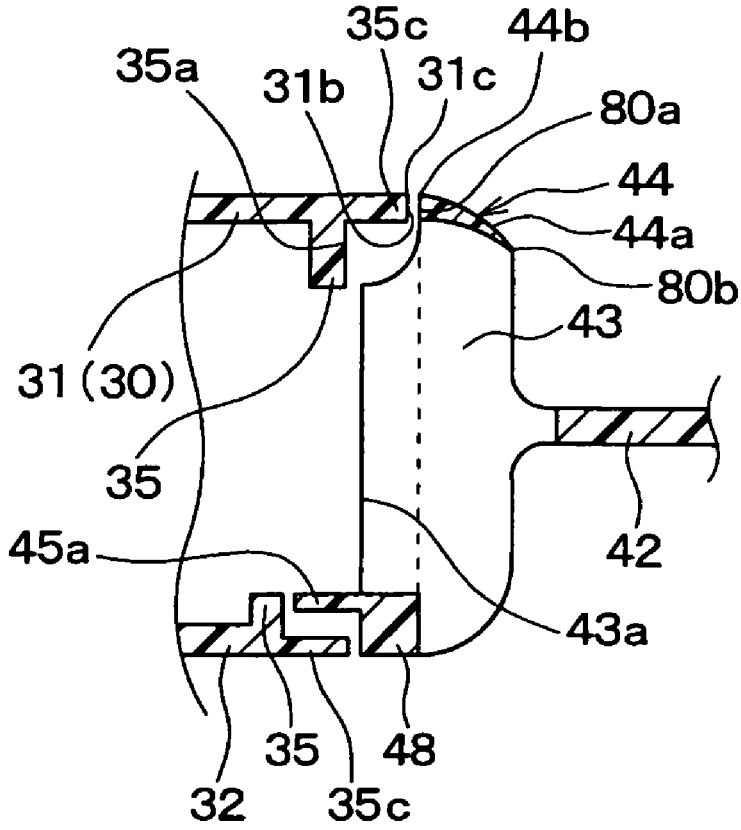
FIG. 19 is a cross-sectional view of a part of the blower unit according to the fourth embodiment.

In FIGS. 18 and 19, component parts similar to the first embodiment are denoted by the same reference characters, and a description thereof is not repeated.

The blower unit 10 is housed in a casing 21*s*. The casing 21*s* has the outside air inlet 21*a*, a first inside air inlet 21*b* and a second inside air inlet 21*d*, on a side, such as on a left side in FIG. 18. The outside air inlet 21*a* and the first inside air inlet 21*b* are located higher than the second inside air inlet 21*d*. A first inside/outside air switching door 22 is operable to open one of the outside air inlet 21*a* and the first inside air inlet 21*b* and to close the other of the outside air inlet 21*a* and the first inside air inlet 21*b*.

Inside of the casing 21*a*, a separation wall 21*e* is provided to separate a first space 81 that is in communication with the outside air inlet 21*a* and the first inside air inlet 21*b* from a second space 82 that is in communication with the second inside air inlet 21*d*. The separation wall 21*e* is formed with a through hole 21*f*. The through hole 21*e* is formed so as to allow the outside air suctioned in the first space 81 from the outside air inlet 21*a* to flow in the second space 82. A second inside/outside air switching door 22*a* is provided in the casing 21*s*. The second inside/outside air switching door 22*a* is operable to open one of the through hole 21*f* and the second inside air inlet 21*d* and to close the other of the through hole 21*f* and the second inside air inlet 21*d*.

The filter 23 is disposed downstream of the first and second spaces 81, 82, such as on a right side of the first and second spaces 81, 82. The filter 23 purifies the air from the first and second spaces 81, 82. The blower unit 10 is disposed on the right side of the filter 23 within the casing 21*s*.

The blower unit 10 includes an upper centrifugal fan 40A, a lower centrifugal fan 40B, an upper scroll casing 30, a lower scroll casing 30, and the electric motor 50.

The electric motor 50 has the motor body 50*b* and the rotation shaft 50*a* extending from opposite sides of the motor body 50*b*, such as from upper and lower sides of the motor body 50*b*. The blades 43 of the upper centrifugal fan 40A suctions the air from axially opposite sides thereof, such as from an upper side and a lower side thereof and blows the air in the radially outward direction.

In the present embodiment, the upper centrifugal fan 40A is disposed at the first end of the rotation shaft 50*a*, and the lower centrifugal fan 40B is disposed at the second end of the rotation shaft 50*a*. In other words, the rotation shaft 50*a* has a first shaft portion extending from the upper side of the motor body 50*b* and a second shaft portion extending from the lower side of the motor body 50*b*. The upper centrifugal fan 40A is supported by the first shaft portion, and the lower centrifugal fan 40B is supported by the second shaft portion.

FIG. 19 shows a part of the blower unit 10, such as a part around the blade 43 and a first wall part (e.g., upper wall) 31 of the scroll casing 30.

The upper centrifugal fan 40A is provided with the ring part (hereinafter, first ring part) 44 at first ends of the blades 43, such as upper ends of the blades 43 in FIG. 18, similar to the fan 40 of the first embodiment. The upper wall 31 of the scroll casing 30 has the projections 35, 35*c* so as to form the labyrinthine sealing structure in the similar manner as that of the embodiment shown in FIG. 9.

The upper centrifugal fan 40A is provided with another ring part (hereinafter, second ring part) 48 at second ends of the blades 43, such as lower ends of the blades 43 in FIG. 18. The second ring part 48 is located inside of an air suction opening 31*d* provided by a second wall part (e.g., lower wall) 32 of the upper scroll casing 30. The second ring part 48 has a ring shape having a center coincident with the axis of the rotation shaft 50*a*. The second ring part 48 supports the second ends of the blades 43. The second ring part 48 restrict the blades 43 from expanding due to the centrifugal force.

As shown in FIG. 19, the second ring part 48 has a projection 45*a*. The lower wall 32 of the upper scroll casing 30 has the projections 35, 35*c*. The projections 35, 35*c* of the lower wall 32 and the projection 45*a* of the second ring part 48 constitute the labyrinthine sealing structure in the similar manner as that of the embodiment shown in FIG. 10.

The lower centrifugal fan 40B has the similar structure as that of the upper centrifugal fan 40A. The upper and lower centrifugal fans 40A, 40B are disposed symmetric with respect to a centerline (imaginary line) L1 between them.

The lower scroll casing 30 has the similar shape as that of the upper scroll casing 30. The upper and lower scroll casings 30 are symmetric with respect to the centerline L1.

In the present embodiment, when rotated by the electric motor 50, the upper centrifugal fan 40A suctions air through the air suction openings 31*a*, 31*d* of the upper scroll casing 30, and blows the air from the radially inner sides of the blades 43 to the radially outer sides of the blades 43. Here, the first ring part 44 leads the air from the air suction opening 31*a* into the radially inner sides of the blades 43. Therefore, even if the upper scroll casing 30 does not have the bell-mouth portion, the air can be effectively conducted from the air suction opening 31*a* into the radially inner space of the upper centrifugal fan 40A by the first ring part 44. The lower centrifugal fan 40B is operated in the similar manner as that of the upper centrifugal fan 40A. Thus, the description of an operation of the lower centrifugal fan 40B is omitted.

Similar to the first embodiment, the arcuate wall 44*a* of the first ring part 44 of the upper centrifugal fan 40A is disposed radially inside of the opening portion 31*b* of the upper wall 31 of the upper scroll casing 30. Therefore, the first ring part 44 does not overlap the upper scroll casing 30, particularly, the upper wall 31 with respect to the axial direction.

Likewise, the arcuate wall 44*a* of the first ring part 44 of the lower centrifugal fan 40B is disposed radially inside of the opening portion 31*b* of the first wall part (e.g., lower wall) 31 of the lower scroll casing 30. Therefore, the first ring part 44 of the lower centrifugal fan 40A does not overlap the lower scroll casing 30, particularly, the lower wall 31 with respect to the axial direction. Accordingly, the size of the blower unit 10 is reduced.

Further, the upper and lower scroll casings 30 and the upper and lower centrifugal fans 40A, 40B can employ any structures of the embodiments shown in FIGS. 5-17.

In the above-described embodiments, the blower unit 10 is exemplarily employed in the vehicle air conditioning apparatus. However, the blower unit 10 can be employed in any other apparatuses or for any other purposes.

In the above-described embodiments, the blower unit 10 is arranged such that the rotation shaft 50*a* extends in the up and down direction. However, the direction of the blower unit 10 in use is not limited to the above direction. Further, the present invention can be implemented by combining the above embodiments in various ways.

Additional advantages and modifications will readily occur to those skilled in the art. The invention in its broader term is therefore not limited to the specific details, representative apparatus, and illustrative examples shown and described.

What is claimed is:

1. A blower unit comprising:

a rotation shaft;

a centrifugal multi-blade fan supported by the rotation shaft, the centrifugal multi-blade fan including a plurality of blades arranged in a circumferential direction defining a center on the rotation shaft; and a blower casing that houses the centrifugal multi-blade fan therein, wherein the blower casing has a wall part on a first axial side with respect to an axial direction along the axis of the rotation shaft, the wall part extending in a radial direction of the centrifugal multi-blade fan and having an opening portion defining an opening, the centrifugal multi-blade fan has a ring part having a ring shape defining a center on the rotation shaft and supporting the blades adjacent to the first axial side of the blower casing with respect to the axial direction, the centrifugal multi-blade fan has a base wall separate from the ring part with respect to the axial direction, the base wall extends in a radially outward direction and toward a second axial side of the blower casing, over a circumference of the rotation shaft, and supports the blades adjacent to the second axial side of the blower casing, the blades are configured to rotate with rotation of the rotation shaft and to blow air from a radially inside of the centrifugal multi-blade fan toward a radially outside of the centrifugal multi-blade fan in accordance with the rotation, the ring part includes an arcuate wall having an arcuate cross-section, the arcuate wall is disposed inside of the opening portion with respect to the radial direction of the centrifugal multi-blade fan, the arcuate wall is disposed such that a maximum diameter portion thereof is located adjacent to the first axial side of the blower casing and a minimum diameter portion thereof is located closer to the second axial side of the blower casing than the maximum diameter portion with respect to the axial direction, the arcuate wall has a curved shape between the maximum diameter portion and the minimum diameter portion, the curved shape protruding toward a flow of air suctioned into the centrifugal multi-blade fan through a radially inner space of the arcuate wall, the casing has an air outlet to discharge air blown out from the centrifugal multi-blade fan, the ring part is disposed so that a clearance is defined between a radially outer portion of the ring part and the opening portion, the blower unit further comprising:

a first part having a ring shape defining a center on the rotation shaft, the first part being disposed on a radially outer side of the blades and extending from the ring part toward the second axial side of the blower casing;

a second part having a ring shape defining a center on the rotation shaft, the second part extending from the wall part of the blower casing toward the second axial side of the blower casing with respect to the axial direction;

a third part having a ring shape defining a center on the rotation shaft, the third part projecting toward the second part from one of the first part and the ring part; and a fourth part having a ring shape defining a center on the rotation shaft, the fourth part projecting toward the first part from one of the second part and the wall part of the blower casing and being displaced from the third part with respect to the axial direction, wherein the first part, the second part, the third part and the fourth part form a labyrinthine structure that reduces a flow of air that flows out from a radially inner side of the blades to an outside of the casing through the clearance while bypassing the air outlet.

2. The blower unit according to claim 1, wherein a ring end of the ring part is located at one of a first position that coincides with a wall end of the opening portion with respect to the axial direction and a second position that is disposed closer to the second axial side of the blower casing than the wall end with respect to the axial direction, the ring end being the furthest portion in the ring part from the second axial side of the blower casing with respect to the axial direction, the wall end being the furthest portion in the opening portion from the second axial side of the blower casing with respect to the axial direction.

3. The blower unit according to claim 1, wherein a wall end of the opening portion is disposed closer to the second axial side of the blower casing than a ring end of the ring part with respect to the axial direction, the ring end being the furthest portion in the ring part from the second axial side of the blower casing with respect to the axial direction, the wall end being the furthest portion in the opening portion from the second axial side of the blower casing with respect to the axial direction.

4. The blower unit according to claim 1, wherein the opening portion includes a small diameter portion and a large diameter portion having a diameter larger than a diameter of the small diameter portion, the small diameter portion being displaced from the large diameter portion in the axial direction, and the arcuate wall is located inside of the small diameter portion with respect to the radial direction of the centrifugal multi-blade fan.

5. The blower unit according to claim 1, wherein the centrifugal multi-blade fan has a boss part that is connected to the rotation shaft and connects to the base wall, and the boss part, the base wall, the blades and the ring part are integral with each other.

6. The blower unit according to claim 1, wherein the third part and the fourth part extend in a direction perpendicular to the axial direction.

7. The blower unit according to claim 1, wherein the first part extends directly from the ring part toward the second axial side of the blower casing.

8. The blower unit according to claim 1, wherein the blades are arranged such that an air passage is formed between any two blades adjacent in the circumferential direction, the blades are configured to rotate with the rotation of the rotation shaft and to blow air drawn from the opening portion from the radially inner side of the blades to the radially outer side of the blades through each air passage in accordance with the rotation, and the first part is provided as an air blocking part that restricts the air blown radially outward by the blades from entering toward the air passage.

9. The blower unit according to claim 8, wherein the air blocking part is disposed along radially outer edges of the blades.

10. The blower unit according to claim 8, wherein the air blocking part has an arcuate portion on a side adjacent to the second axial side of the blower casing, the arcuate portion projecting toward the radially inside and the second axial end of the blower casing to guide the flow of air blown radially outward by the blades to incline toward the second axial side of the blower casing.

11. A bower unit comprising:

an electric motor including a motor body and a rotation shaft rotated by the motor body, the rotation shaft extending from opposite axial ends of the motor body with respect to an axial direction;

a first centrifugal multi-blade fan supported by the rotation shaft on one axial side of the motor body, the first centrifugal multi-blade fan including a plurality of first blades arranged in a circumferential direction defining a center on the rotation shaft; and a first blower casing that houses the first centrifugal multi-blade fan therein, wherein the first blower casing has a first wall part having a first opening portion defining an opening, the first wall part extending in a radial direction of the first centrifugal multi-blade fan on the one side of the motor body, the first centrifugal multi-blade fan has a first ring part having a ring shape defining a center on the rotation shaft, the first ring part supporting the first blades on a side adjacent to the first wall part, and the first blades are configured to rotate with rotation of the rotation shaft and to blow air from a radially inner side of the first blades to a radially outer side of the first blades in accordance with the rotation, the blower unit further comprising:

a second centrifugal multi-blade fan supported by the rotation shaft on the other axial side of the motor body, the second centrifugal multi-blade fan having a plurality of second blades arranged in a circumferential direction defining a center on the rotation shaft; and a second blower casing that houses the second centrifugal multi-blade fan therein, wherein the second blower casing has a second wall part having a second opening portion defining an opening, the second wall part extending in a radial direction of the second centrifugal multi-blade fan on the other axial side of the motor body, the second centrifugal multi-blade fan has a second ring part having a ring shape defining a center on the rotation shaft, the second ring part supporting the second blades on a side adjacent to the second wall part, and the second blades are configured to rotate with rotation of the rotation shaft and to blow air from a radially inner side of the second blades to a radially outer side of the second blades in accordance with the rotation, the first ring part and the second ring part have a first arcuate wall and a second arcuate wall each having an arcuate cross-section, respectively, the first arcuate wall and the second arcuate wall are disposed inside of the first opening portion and the second opening portion, respectively, with respect to the radial direction of the first and second centrifugal multi-blade fans, the first arcuate wall is disposed such that a maximum diameter portion thereof is located adjacent to the first wall part and a minimum diameter portion thereof is located closer to the motor body than the maximum diameter portion with respect to the axial direction, the second arcuate wall is disposed such that a maximum diameter portion thereof is located adjacent to the second wall part and a minimum diameter portion thereof is located closer to the motor body than the maximum diameter portion with respect to the axial direction, each of the first arcuate wall and the second arcuate wall has a curved shape between the maximum diameter portion and the minimum diameter portion, the curved shape projecting toward a flow of air suctioned into the corresponding centrifugal multi-blade fan through a radially inner space of the corresponding arcuate wall, the first blower casing has a first air outlet to discharge air blown out from the first centrifugal multi-blade fan, the second blower casing has a second air outlet to discharge air blown out from the second centrifugal multi-blade fan, the first ring part is disposed such that a first clearance is defined between a radially outer portion of the first ring part and the first opening portion, the second ring part is disposed such that a second clearance is defined between a radially outer portion of the second ring part and the second opening portion, the blower unit further comprising:

a first part having a ring shape defining a center on the rotation shaft, the first part being disposed on a radially outer side of the first blades and extending from the first ring part toward the motor body;

a second part having a ring shape defining a center on the rotation shaft, the second part extending from the first wall part of the first blower casing toward the motor body;

a third part having a ring shape defining a center on the rotation shaft, the third part projecting toward the second part from one of the first part and the first ring part; and a fourth part having a ring shape defining a center on the rotation shaft, the fourth part projecting toward the first part from one of the second part and the first wall part of the first blower casing and being displaced from the third part with respect to the axial direction, wherein the first part, the second part, the third part and the fourth part form a first labyrinthine structure that reduces a flow of air that flows out from the radially inner side of the first blades to an outside of the first blower casing through the first clearance while bypassing the first air outlet, the blower unit further comprising:

a fifth part having a ring shape defining a center on the rotation shaft, the fifth part being disposed on a radially outer side of the second blades and extending from the second ring part toward the motor body;

a sixth part having a ring shape defining a center on the rotation shaft, the sixth part extending from the second wall part of the second blower casing toward the motor body;

a seventh part having a ring shape defining a center on the rotation shaft, the seventh part projecting toward the sixth part from one of the fifth part and the second ring part; and an eighth part having a ring shape defining a center on the rotation shaft, the eighth part projecting toward the fifth part from one of the sixth part and the second wall part of the second blower casing and being displaced from the seventh part with respect to the axial direction, wherein the fifth part, the sixth part, the seventh part and the eighth part form a second labyrinthine structure that reduces a flow of air that flows out from the radially inner side of the second blades to an outside of the second blower casing through the second clearance while bypassing the second air outlet.

12. A blower unit comprising:

a rotation shaft;

an electric motor including a motor body rotating the rotation shift;

a centrifugal multi-blade fan supported by the rotation shaft, the centrifugal multi-blade fan including a plurality of blades arranged in a circumferential direction defining a center on the rotation shaft; and a blower casing that houses the centrifugal multi-blade fan therein, wherein the blower casing has a wall part on a first axial side opposite to the motor body with respect to an axial direction along the axis of the rotation shaft, the wall part extending in a radial direction of the centrifugal multi-blade fan and having an opening portion defining a suction port, the centrifugal multi-blade fan has a ring part having a ring shape defining a center on the rotation shaft and supporting the blades adjacent to the first axial side of the blower casing with respect to the axial direction, the blades are configured to rotate with rotation of the rotation shaft and to suck air through the suction port and blow air from a radially inside of the centrifugal multi-blade fan toward a radially outside of the centrifugal multi-blade fan in accordance with the rotation, the ring part includes an arcuate wall having an arcuate cross-section, the arcuate wall is disposed inside of the suction port with respect to the radial direction of the centrifugal multi-blade fan, the arcuate wall is disposed such that a maximum diameter portion thereof is located adjacent to the first axial side of the blower casing and a minimum diameter portion thereof is located closer to a second axial side of the blower casing than the maximum diameter portion with respect to the axial direction, the arcuate wall has a curved shape between the maximum diameter portion and the minimum diameter portion, the curved shape protruding toward a flow of air suctioned into the centrifugal multi-blade fan through a radially inner space of the arcuate wall, the casing has an air outlet to discharge air blown out from the centrifugal multi-blade fan, the ring part is disposed so that a clearance is defined between a radially outer portion of the ring part and the opening portion, the blower unit further comprising:

a first part having a ring shape defining a center on the rotation shaft, the first part being disposed on a radially outer side of the blades and extending directly from the ring part toward the second axial side of the blower casing;

a second part having a ring shape defining a center on the rotation shaft, the second part extending from the wall part of the blower casing toward the second axial side of the blower casing with respect to the axial direction;

a third part having a ring shape defining a center on the rotation shaft, the third part projecting toward the second part from one of the first part and the ring part; and a fourth part having a ring shape defining a center on the rotation shaft, the fourth part projecting toward the first part from one of the second part and the wall part of the blower casing and being displaced from the third part with respect to the axial direction, wherein the first part, the second part, the third part and the fourth part form a labyrinthine structure that reduces a flow of air that flows out from a radially inner side of the blades to an outside of the casing through the clearance while bypassing the air outlet.

* * * * *